United States Patent [19]

Wiles et al.

[11] 4,387,817

[45] Jun. 14, 1983

[54] CHILD RESISTANT CONTAINER COVER

[75] Inventors: Laurence E. Wiles; Frank C. Page, III, both of Cheshire; Bruno A. Eibensteiner, Waterbury, all of Conn.

[73] Assignees: Ethyl Products Company, Richmond, Va.

[21] Appl. No.: 312,804

[22] Filed: Oct. 19, 1981

Related U.S. Application Data

[63] Continuation-in-part of Ser. No. 161,130, Jun. 19, 1980, abandoned.

[51] Int. Cl.[3] ..... B65D 55/02

[52] U.S. Cl. ..... 215/217; 215/222

[58] Field of Search ..... 215/217, 222, 214, 218

[56] References Cited

U.S. PATENT DOCUMENTS

| | | | |
|---|---|---|---|
| 3,072,276 | 1/1963 | Nichols | 215/222 |
| 3,883,376 | 6/1975 | Cooke | 215/217 |
| 3,927,783 | 12/1975 | Bogert | 215/222 |
| 4,057,159 | 11/1977 | Fillmore et al. | 215/222 |
| 4,139,112 | 2/1979 | Cooke | 215/217 |
| 4,346,809 | 8/1982 | Kusz | 215/222 |

*Primary Examiner*—George T. Hall

*Attorney, Agent, or Firm*—Donald L. Johnson; John F. Sieberth; Edgar E. Spielman, Jr.

[57] ABSTRACT

A child-resistant package characterized by a container with a threaded neck portion, a closure provided with a multiplicity of threads cooperatively engaging the threads on the neck portion, means connected to the threaded neck portion for stopping the threading rotation of the closure onto the threaded neck portion at a predetermined position, and resilient liner means interposed between the underside of the top of the closure and the top of the neck portion.

34 Claims, 13 Drawing Figures

CHILD RESISTANT CONTAINER COVER

CROSS REFERENCE TO RELATED APPLICATION

This application is a continuation-in-part of our copending application, Ser. No. 161,130, filed June 19, 1980, now abandoned.

BACKGROUND OF THE INVENTION

Many child-resistant closures have been suggested in recent years because of greater activity directed towards insuring that dangerous and poisonous materials be packaged in containers which are significantly difficult for small children to open.

Exemplary of the containers and closures developed by the art in response to this need is the closure and container shown in U.S. Pat. No. 3,888,376. This container and closure is in the class of child-resistant packages which feature latching and unlatching means carried by the threads of the closure and the container. Generally, this class is beset by the problem of requiring very exact container and closure manufacture so that registration of the latching structure can be predictably effected. The manufacturing standards required are oftentimes difficult to achieve when it is considered that the packager oftentimes purchases the containers from sources separate from the closures.

Despite these difficulties, however, this class of child-resistant closure and container is highly desirable in that the locking mechanism is carried internal to the package when the closure is fitted to the container. Other classes of child-resistant closures and containers which rely upon exterior locking systems oftentimes are not entirely satisfactory as a child is free to attack the locking structure.

Therefore, it is an object of this invention to provide a container and closure which is child-resistant, which is in the class of containers and closures which have the locking systems carried by the threads of the containers and closures, and which is able to achieve its child-resistant locking position without demand for highly critical manufacturing tolerances. Furthermore, it is an object of the invention to provide a container and closure combination in which the closure can be oriented to a predetermined position on the container.

THE INVENTION

This invention relates to a safety closure for containers having a threaded neck portion, said closure providing a multiplicity of threads cooperatively engaging the threads on the neck portion. The neck portion has means for stopping the threading rotation of the closure onto the threaded neck portion at a predetermined position. The closure also uses a resilient liner means interposed between the underside of the top of the closure and the top of the neck portion.

More particularly, this invention relates to a child-resistant package comprising a container, having about its neck, a plurality of interrupted helical threads and a closure having, about the inside surface of its annular sidewall, a like number of helical thread segments, which interrupted threads and thread segments have dimensions and configurations for cooperation with one another to effect child-resistant fitment of the closure to the container.

Each of the closure thread segments have at their start end an arrowhead portion which terminates in an inwardly projecting latitudinally extending surface which is substantially parallel to the center axis of the closure. For this surface the thread continues to its finish end and has a conventional thread configuration.

The container interrupted threads are preferably even in number, e.g. 2, 4, 6, 8 etc. In any case, at least two of the container threads, which are generally opposite one another, will have a conventional configuration at their start end but have at their finish ends gaps which are dimensioned for receipt of the arrowhead portion of the closure thread. The portion of each gap most proximate the start end of the container thread is defined by an outwardly projecting latitudinally extending surface which is substantially parallel to the center axis of the container. At the distal end of each gap, there is provided, in association with the container thread or as a part thereof, a stopping surface which limits the travel of the closure thread segment associated with the container thread.

The remaining threads, i.e. those not having the gap-stop configuration, are of a general conventional configuration. At their finish ends, they can have a surface similar in configuration to the before-described proximate surface which is associated with each gap.

Threading of the closure onto the cooperating container neck threads is performed in a conventional manner. The arrow-head portion of the closure threads will ride on the underside of the container thread until they fall into the gaps, as would be the case when the particular closure thread is associated with a container thread having a gap, or until they run off of the thread, as is the case when a non-gapped container thread is involved. When the arrowhead portion is in a gap, the before-described latitudinal surfaces, i.e. the surface which defines the terminal end of the arrowhead portion and the latidudinal surface which defines the proximate end of the gap, will be in face-to-face abutment. This abutment acts as a lock to prevent removal rotation of the closure. To maintain the lock and to provide release of the lock, there is provided a spring structure, e.g. a resilient liner, which acts to maintain upward axial spring tension against the top of closure when the lock position is achieved. This tension keeps the arrowhead portion in the gap. To release the lock, axial downward force is applied to the closure which compresses or flexes the spring structure and allows the closure to move axially downward. This downward motion results in the arrowhead portion being moved out of the gap thus avoiding the before-described surface-surface abutment. With this accomplished, removal rotation is permissible.

An advantage of the container and closure of this invention is a low application torque, ability to give a tight seal, and easy opening for adults. In a preferred form, a resilient disc liner acts as both a spring to maintain the required vertical pressure while at the same time providing a high fidelity seal against a vacuum and normal environmental atmosphere. Another advantage is that an odd shaped cap can be oriented to match a conforming container, e.g., a square cap can be aligned with the sides of a square container.

These and other features contributing to satisfaction in use and economy in manufacture will be more fully understood from the following description of a preferred embodiment of the invention when taken in connection with the accompanying drawings wherein identical numerals refer to identical parts and in which.

DESCRIPTION OF THE PREFERRED EMBODIMENTS

Figure 1:
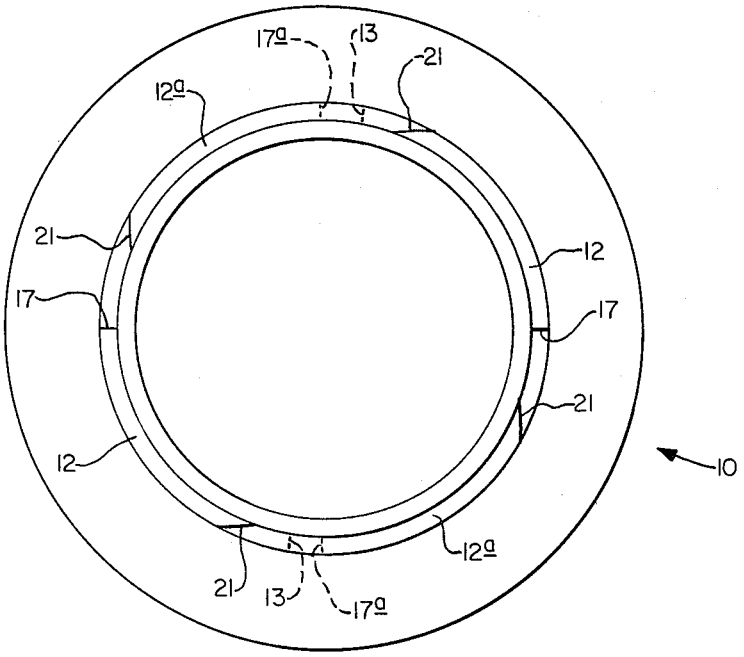
FIG. 1 is a top view of a container of this invention.

Referring now to the drawings, a conventional container 10 is provided which, while preferably made of plastic, may be made of glass or other suitable material. The container has the usual neck portion 11 provided with threads 12 and 12*a* which, when the container is made of plastic, may be molded. Threads 12 and 12*a* have trailing edges 17 and 17*a*, respectively, which are generally parallel to the center line of the closure.

As can be seen in the drawings, the two threads 12*a* have a stop 13 at the end thereof which together with surface 17*a* define gap 13*a* whereas the two threads 12 do not have a stop at the end thereof, although they do have surface 17 which contacts surface 16*a* in the locked position.

Figure 6:
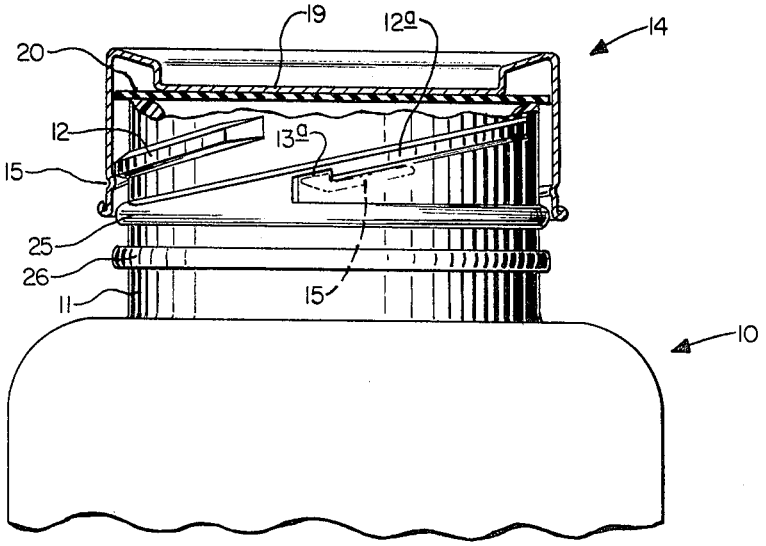
FIG. 6 is a partly cut-away side elevational view of the closure attached to the container shown.

The sidewall of closure 14 has four harpoon-shaped threads 15 equally spaced at approximately 90 degrees apart. The harpoon-shaped threads 15 have an arrowhead portion 16 thereon, the surface 16*a* behind the arrowhead 16 being generally parallel to the centerline of the closure and being designed to interlock in gap 13*a* as shown in FIG. 6 in the "ghosted" thread 15. The surface line of the top 16*b* of arrowhead portion 16 is generally parallel to the bottom 12*b* of threads 12 and 12*a* to reduce thread damage, as is the tail of thread 15.

The top of the neck has the usual bearing surface 18. The underside of closure 14 has a depressed top portion 19 which can be molded in the closure when it is made of plastic or embossed in the closure when the closure is made of metal. Lying between the top 18 of the neck 11 and the depressed portion of the closure 14 is a liner 20. Liner 20 is made of some suitable resilient material which in conjunction with the depressed portion 19 of closure 14 seals the top 18 of container 10 to prevent any fluids flowing therefrom.

Figure 7:
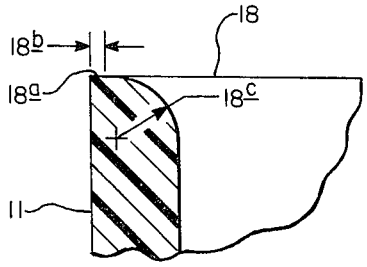
FIG. 7 is an enlarged, cut-away, partly sectional view of the top of the neck of the container.

The top 18 of container 10 preferably includes a sealing surface 18*a* (see FIG. 7). Sealing surface 18*a* includes a flat portion 18*b* and a curved or radiused surface 18*c*. Both 18*b* and 18*c* cooperate to assure a tight seal.

In assembling the closure to the neck of the container, it is merely necessary to manually turn the closure in a manner to screw the closure onto the neck of the container. Closures made in accordance with the invention can be attached to the container with a torque as low as 10 to 12 inch-pounds. The leading edge of the threads 12*a* and 12 have a tapered surface 21 which acts in conjunction with arrowhead portion 16 of threads 15 to insure ease of threading. When the closure is fitted on the neck of the container and released, the action caused by the depressed member 19 bearing on the liner 20 will cause the closure to move to a slight degree upwardly to securely lock the arrowhead portion 16 in gap 13*a*.

In order to open the closure, it is necessary to exert a downward pressure against the action of the member 19 and the liner 20 whereupon the arrowhead 16 will be forced downward and out of gap 13*a* and in the same movement the closure may be turned to unscrew the closure from the neck of the container. Thus, it may be seen that the present invention provides a one-piece safety closure obtaining a positive lock against inadvertent opening.

Preferably, two sealing bands 25 and 26 are provided at the bottom of neck 11. These sealing bands 25 and 26 provide several functions. They help prevent the container from going out-of-round during high application torque and they serve as a bacteria baffle.

As can be seen from the above, an odd-shaped container having a corresponding odd-shaped closure is feasible in accordance with the present invention because the closure can be oriented and aligned with the sides of the container to make the combined cap and container symmetric and esthetically pleasing. For example, a square closure can be fitted to a square container by positioning stops 13—13 in the appropriate place on neck 11.

Figure 3:
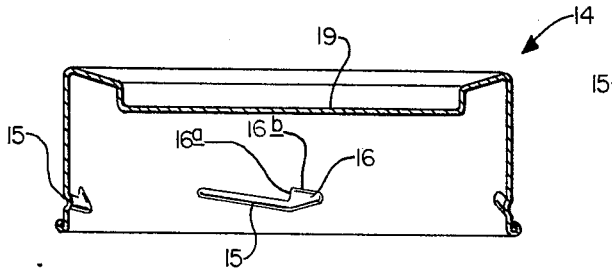
FIG. 3 is a cross-sectional view of a closure of this invention.
Figure 4:
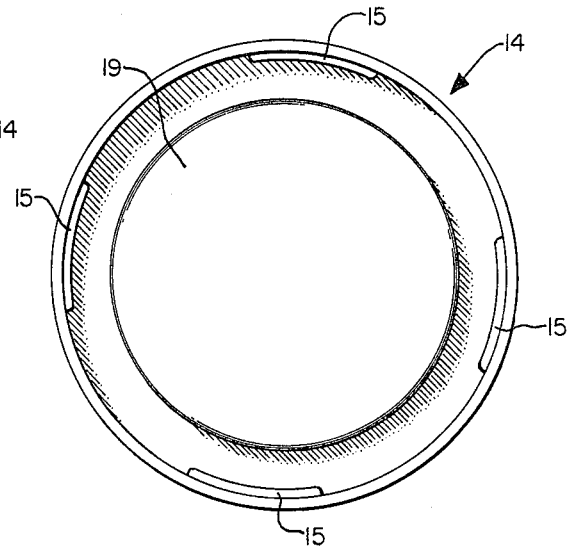
FIG. 4 is a bottom view taken of the closure shown in FIG. 3.
Figure 5:
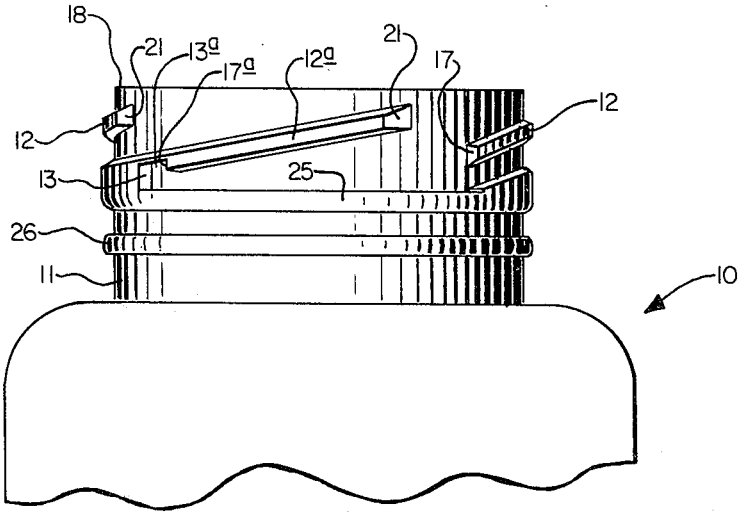
FIG. 5 is a side view of the closure shown in FIG. 2 rotated to show another view of the threads.

Additional embodiments of the closure of this invention are shown in FIGS. 8–13. These embodiments feature a planar top wall which will provide more labeling space than is provided by the first-described embodiment shown in FIGS. 3 and 4. Achievement of the axial action provided by liner 20 and depressed portion 19 of the first-described embodiment is realized, for the embodiments of FIGS. 8–13, by the utilization of structure downwardly extending from the closure top wall and which acts against the liner in the sme manner as depressed portion 19. Except for the top wall configuration and the presence of the structure which extends downwardly from the top wall, the closures of FIGS. 8–13 are substantially identical in configuration and operational function as the first-described closure. Also, these last-described closures can be made of metal or thermoplastic material, with the latter being preferred due to the ease in obtainment of the depicted configurations by the use of thermoplastic injection molding techniques.

Figure 8:
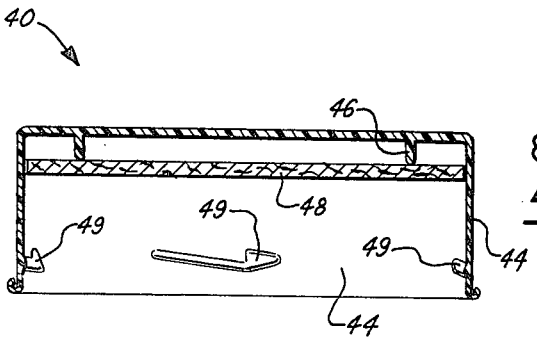
FIG. 8 is a cross-sectional view of another closure of this invention.
Figure 9:
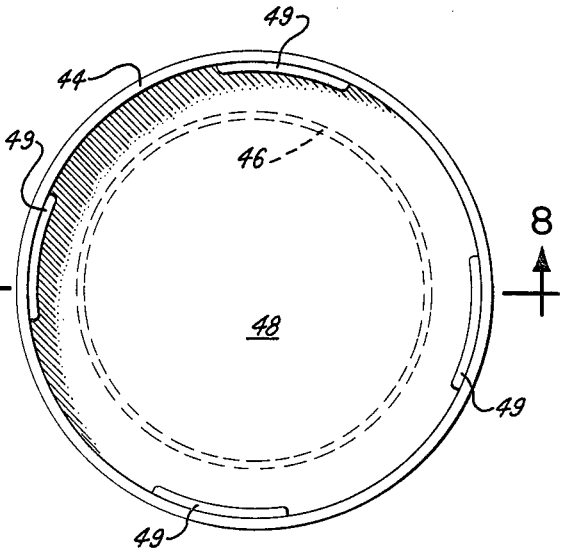
FIG. 9 is a bottom view of the closure shown in FIG. 8.

The embodiment shown in FIGS. 8 and 9 features a closure having a planar circular top wall 42 which has dependent therefrom, downwardly extending annular sidewall 44. About the inside surface of annular sidewall 44 are a plurality of helical threads segments 49 which segments are identical in configuration and function as the before-described thread segments 15. Downwardly dependent and integral with top wall 42 is annular boss 46, which has positioned at its distal end, liner 20. Note that annular boss 46 is dimensioned so as to have a diameter less than the outside diameter of container 10 and such that it overlies radiused surface 18*c* of container 10. By overlying this surface vertical movement of closure 14 acting against the resiliency of liner 20 is possible. If annular boss 46 overlay flat portion 18*b*, such vertical motion would be stymied since annular boss 46 and liner 20 would be in non-yieldable abutment with flat portion 18*b*. Since vertical room for flexing can also be provided by having annular boss 46 with a diameter smaller than the inside diameter of container 10, this positional relationship is also functionally operative. Determination of the optimum diameter of annular boss 46 will be dependent, for the most part, on the diameter of closure 14 and the material of construction for liner 20, e.g. metal, resilient plastics, etc.

Figure 10:
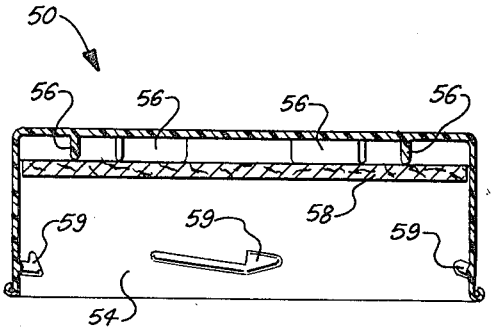
FIG. 10 is a cross-sectional view of another closure of this invention.
Figure 11:
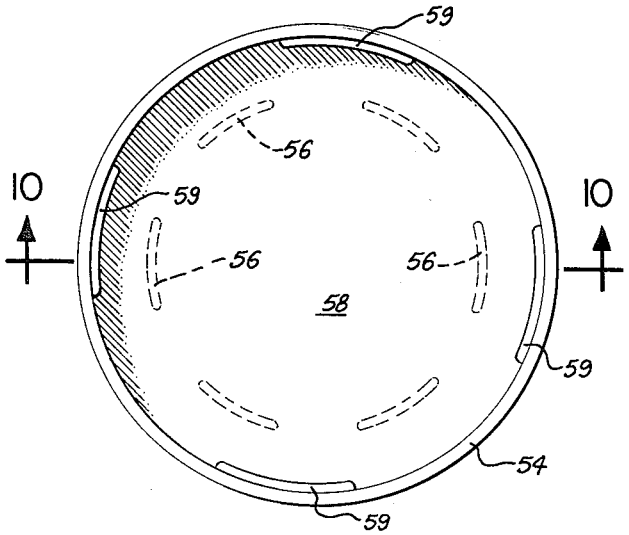
FIG. 11 is a bottom view of the closure shown in FIG. 10.

The embodiment shown in FIGS. 10 and 11 features a closure with a planar circular top wall 52 and a downwardly depending annular sidewall 54. About the inside surface of annular sidewall 54, there is a plurality of helical thread segments 59 which are identical to helical thread segments 15. Downwardly dependent and integrally formed with top wall 52 are a plurality of annularly positioned bosses 56. These bosses are preferably equiangularly positioned and indicate a circle having a diameter which is in the same relationship with the top 18 of container 10 as described for the diameter of annular boss 46 of the embodiment shown in FIGS. 8 and 9. Liner 20 serves the same function for this embodiment as far the other embodiments.

Figure 12:
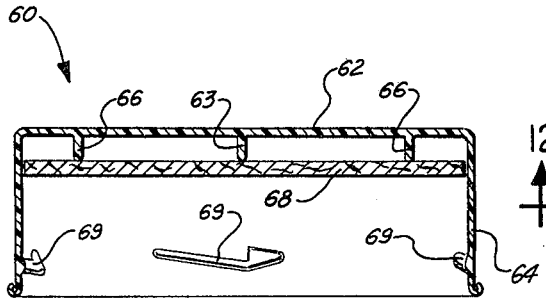
FIG. 12 is a cross-sectional view of another closure of this invention.
Figure 13:
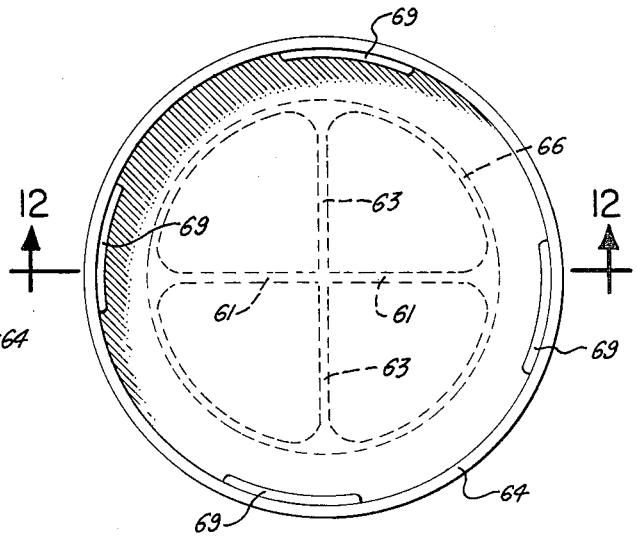
FIG. 13 is a bottom view of the closure shown in FIG. 12.

In FIGS. 12 and 13, another closure of this invention is shown. This closure features a planar circular top wall 62 and annular sidewall 64 which is downwardly dependent therefrom. As is the case for the prior described embodiments, helical thread segments having an arrowhead portion at their start end are positioned about the inside surface of the closure sidewall. For this embodiment, these segments are labeled with the number 69. Depending downwardly from the inside surface of top wall 62 is annular boss 66.

To provide closure top wall rigidity this embodiment utilizes two support walls which intersect at 90° and at the center of the circle defined by annular boss 66. The intersecting walls, labeled 62 and 63, each extend fully across annular boss 66. The diameter of annular boss 66 is determined by the same considerations used for the other embodiments. Liner 20 is positioned adjacent the distal end of annular boss 66 and contribute to the axial spring function previously described for the other embodiments.

Figure 2:
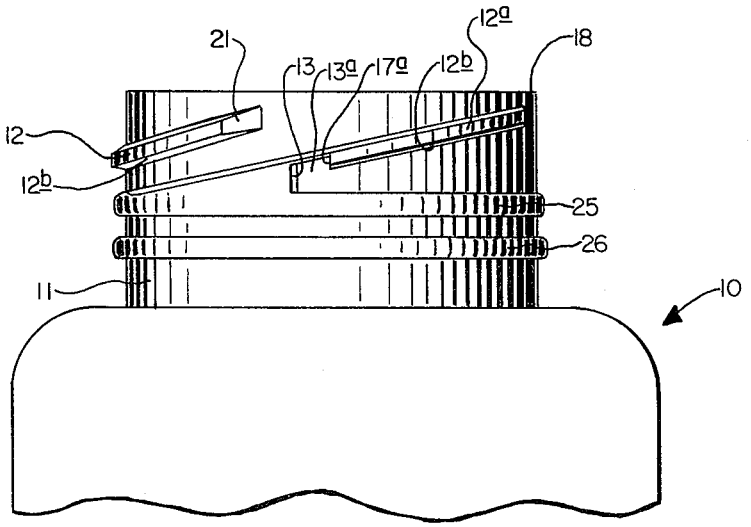
FIG. 2 is a side view of a container of this invention.

The closure of FIGS. 8–13 can be utilized on a container having a neck finish as shown in FIG. 2. The manner of operation, to achieve fitment of the closure to the container and the child-resistant lock, and to achieve the release if that lock is the same as described for the embodiment shown in FIGS. 3–4.

While the invention has been described in detail in connection with the depicted embodiments thereof, the descriptions and illustrations are in no way intended to limit the scope of the invention.

What is claimed:

1. A child-resistant package comprising a closure and container, said package characterized by:

a. said container having a threaded neck portion;

b. said closure being provided with a multiplicity of threads having arrowhead-shaped portions on one end thereof;

c. means connected to said threaded neck portion for stopping the threading rotation of said closure onto said threaded neck portion at a predetermined position, said means including a gap in at least two of said threads on said neck portion adapted for receipt of said arrowhead-shaped portion therein, said gap being defined by i. a raised stop at the end of at least two of said threads on said neck portion against which the end of at least two of said threads on said closure strikes when said closure is threaded onto said neck portion, and ii. the end of said threads on said neck portion; and d. resilient liner means interposed between the underside of the top of said closure and the top of said neck portion.

2. The package of claim 1 wherein said threads on said neck portion are generally helical in shape.

3. The package of claim 1 wherein there is a surface behind said arrowhead-shaped portion which is generally parallel to the centerline of the closure and is adapted to interlock in said gap.

4. The package of claim 3 wherein said closure has a depressed portion on the top thereof which abuts said resilient liner when said closure is screwed onto said threaded neck portion.

5. The package of claim 4 wherein said threaded neck portion has a sealing top which includes a flat, circular, upward facing portion for making sealing contact with said liner.

6. The package of claim 5 wherein the top of said neck portion includes a curved inner portion adjacent to a flat, circular, upward facing portion.

7. The package of claim 6 wherein the leading edge of said threads on said threaded neck portion are beveled.

8. The package of claim 6 wherein said threads on said closure are harpoon-shaped which have said arrowhead-shaped portion at one end thereof.

9. A safety closure for fitment to a container having a threaded neck portion and means connected to said threaded neck portion for stopping the threading rotation of said closure onto said threaded neck portion at a predetermined position, said means including a gap in at least two of said threads on said neck portion, said gap being defined by a raised stop at the end of at least two of said threads on said neck portion against which the end of at least two of said threads on said closure strikes when said closure is threaded onto said neck portion and the end of said threads on said neck portion and said closure having a multiplicity of threads having arrowhead-shaped portions on one end thereof, said arrowhead portions being adapted for receipt into said gaps.

10. The closure of claim 9 wherein there is a surface behind said arrowhead-shaped portion which is generally parallel to the centerline of the closure and is adapted to interlock in said gap.

11. The closure of claim 10 wherein said closure has a depressed portion on the top thereof which abuts a resilient liner when said closure is screwed onto said threaded neck portion.

12. The closure of claim 11 wherein the top of said neck portion includes a curved inner portion adjacent to a flat, circular, upward facing portion.

13. The closure of claim 12 wherein said threads on said closure are harpoon-shaped which have said arrowhead-shaped portions at one end thereof.

14. A container fittable with a closure having threads thereon which have an arrowhead-shaped portion at one end thereof, said container comprising:

a. a body portion;

b. a cylindrical neck portion having means connected thereto for stopping the threading rotation of said closure onto said neck portion at a predetermined position; and c. a plurality of threads spaced about the outside circumference of said neck portion.

15. The container of claim 14 wherein at least two of said threads on said neck portion have a gap therein for receipt of said arrowhead-shaped portion therein.

16. The container of claim 15 wherein said means for stopping the threading rotation of said closure comprises a raised stop at the end of at least two of said threads on said neck portion against which the ends of at least two of said threads on said closure strike when said closure is threaded onto said neck portion.

17. The container of claim 16 wherein said threads on said neck portion are generally helical in shape.

18. The container of claim 17 wherein said threads on said closure are harpoon-shaped and have an arrowhead-shaped portion at one end thereof.

19. A child resistant package having a closure fittable to the neck portion of a container, said closure comprising:

a top wall;

an annular sidewall downwardly extending from said top wall;

a plurality of helical thread segments about the inside surface of said annular sidewall, each of said thread segments having an arrowhead portion at its start end and having, rearward of said arrowhead portion, a latitudinally extending surface which is substantially parallel to the center axis of said clousre and which extends inwardly of said closure;

spring means for urging said closure in an upward axial direction when said closure is fitted to said neck portion and for allowing downward axial movement of said closure, when said closure is fitted to said neck portion, upon the application of a downward axial force on said closure; and said container comprising:

a body portion terminating into said neck portion;

a plurality of interrupted helical threads about the outside surface of said neck portion for threading cooperation with said helical thread segments, each of said helical threads having at its finish end an outwardly projecting latitudinally extending surface which is substantially parallel to the center axis of said container;

stop means on the outside surface of said neck portion and laterally displaced from the outwardly projecting latitudinally extending surfaces of at least two of said interrupted helical threads, said stop means blocking continued threading, at a predetermined point, of said closure onto said neck portion and said lateral displacement being of sufficient magnitude to allow nesting of said arrowhead portion, between said stop means and said outwardly projecting latitudinally extending surface, at the urging of said spring means when said stop means blocks said continued threading whereby said latitudinal extending surfaces of said helical thread segments and of said helical interrupted threads can achieve abutment for locking said closure against removal rotation with respect to said container.

20. The package of claim 19 wherein said spring means comprises a depressed portion of top wall and a resilient liner having a portion thereof in abutment with said depressed portion.

21. The package of claim 19 wherein said spring means comprises an annular boss downwardly depending from said top wall and a resilient liner having a portion thereof in abutment with said annular boss.

22. The package of claim 19 wherein said spring means comprises a plurality of annularly positioned bosses downwardly depending from said top wall and a resilient liner having a portion thereof in abutment with said annularly positioned bosses.

23. The package of claim 21 wherein there is additionally provided two intersecting support walls downwardly depending from said top wall, said support walls intersecting at substantially 90° angles at the center of the circle defined by said annular boss.

24. The package of claim 19 wherein each of said stop means comprises an outwardly projecting stop wall.

25. The package of claim 24 wherein, for each of said interrupted helical threads having a stop wall associated therewith, said stop wall and said outwardly projecting latitudinally extending surface are joined at their upper ends by a continuation of the upper portion of said interrupted helical thread.

26. A child resistant closure fittable to a container neck which neck carries a plurality of interrupted helical threads and stopping structure laterally displaced from the finish end of at least two of said interrupted helical threads to define a gap between the finish end and the stopping structure and to block continued threading of said closure onto said container, said closure comprising:

a top wall;

an annular sidewall downwardly extending from said top wall;

a plurality of helical thread segments about the inside surface of said annular sidewall for threading cooperation with said interrupted helical threads, each of said thread segments having an inwardly protruding arrowhead portion at its start end, and having, rearward of said arrowhead portion, an inwardly projecting latitudinally extending surface which is substantially parallel to the center axis of said closure; and a spring means for urging said closure in an upward axial direction to nest said arrowhead portion in said gap when said closure is fitted to said neck portion and said spring means allowing downward axial movement of said closure, upon the application of a downward axial force on said closure, to effect unnesting of said arrowhead portion from said gap, said nesting providing locking engagement between said latitudinally extending surface and at least a portion of said gap to prevent removal rotation of said closure from said container, and said unnesting effecting release of said locking engagement.

27. The closure of claim 26 wherein said spring means comprises a depressed portion of top wall and a resilient liner having a portion thereof in abutment with said depressed portion.

28. The closure of claim 26 wherein said spring means comprises an annular boss downwardly depending from said top wall and a resilient liner having a portion thereof in abutment with said annular boss.

29. The closure of claim 26 wherein said spring means comprises a plurality of annularly positioned bosses downwardly depending from said top wall and a resilient liner having a portion thereof in abutment with said annularly positioned bosses.

30. The closure of claim 28 wherein there is additionally provided two intersecting support walls downwardly depending from said top wall, said support walls intersecting at substantially 90° angles at the center of the circle defined by said annular boss.

31. The closure of claim 26 wherein said at least a portion of said gap comprises an outwardly projecting latitudinally extending surface at each of the finish ends of said at least two interrupted helical threads.

32. A container for providing a child resistant package when used in conjunction with a closure having a plurality of helical thread segments about the inside surface of its annular sidewall in which the thread segments have arrowhead portions at their start ends and in which said closure has spring means for urging said closure axially upward when said closure is fitted to said container but allows downward axial motion of said closure upon the application of a downward axial force to said closure, said container comprising:

a body portion terminating into a neck portion;

a plurality of interrupted helical threads about the outside surface of said neck portion for threading cooperation with said helical thread segments, each of said helical threads having at its finish end an outwardly projecting latitudinally extending surface which is substantially parallel to the center axis of said container;

stop means on the outside surface of said neck portion and laterally displaced from the outwardly projecting latitudinally extending surfaces of at least two of said interrupted helical threads, said stop means blocking continued threading, at a predetermined point, of said closure onto said neck portion and said lateral displacement being of sufficient magnitude to allow nesting of said arrowhead portion, between said stop means and said outwardly projecting latitudinally extending surface, at the urging of said spring means when said stop means blocks said continued threading whereby said outwardly projecting latitudinal extending surfaces of said interrupted helical threads can achieve abutment with latitudinal extending surfaces carried by the closure sidewall rearwardly of said arrowhead portions, for locking said closure against removal rotation with respect to said container.

33. The package of claim 32 wherein each of said stop means comprises an outwardly projecting stop wall on said neck portion.

34. The package of claim 33 wherein, for each of said interrupted helical threads having a stop wall associated therewith, said stop wall and said outwardly projecting latitudinally extending surface are joined at their upper ends by a continuation of the upper portion of said interrupted helical thread.

* * * * *